US008410698B2

(12) United States Patent
Haacke et al.

(10) Patent No.: US 8,410,698 B2
(45) Date of Patent: Apr. 2, 2013

(54) HIGH EFFICIENCY DISCHARGE LAMP

(75) Inventors: Michael Haacke, Aachen (DE); Ulrich Hechtfischer, Aachen (DE)

(73) Assignee: Koninklijke Philips Electronics N. V., Eindhoven (NL)

( * ) Notice: Subject to any disclaimer, the term of this patent is extended or adjusted under 35 U.S.C. 154(b) by 145 days.

(21) Appl. No.: 12/936,541

(22) PCT Filed: Apr. 7, 2009

(86) PCT No.: PCT/IB2009/051450

§ 371 (c)(1), (2), (4) Date: Oct. 6, 2010

(87) PCT Pub. No.: WO2009/127993

PCT Pub. Date: Oct. 22, 2009

(65) Prior Publication Data

US 2011/0031878 A1 Feb. 10, 2011

(30) Foreign Application Priority Data

Apr. 14, 2008 (EP) ..... 08103522

(51) Int. Cl.
*H01J 61/12* (2006.01)
*H01J 61/22* (2006.01)
*H01J 17/20* (2012.01)

(52) U.S. Cl. ..... 313/637; 313/638; 313/640

(58) Field of Classification Search ..... 313/631–643
See application file for complete search history.

(56) References Cited

U.S. PATENT DOCUMENTS

| | | | | |
|---|---|---|---|---|
| 6,265,827 | B1 * | 7/2001 | Takahashi et al. | 313/638 |
| 6,653,801 | B1 * | 11/2003 | Takeda et al. | 315/246 |
| 7,038,385 | B2 * | 5/2006 | Takagaki et al. | 313/631 |
| 7,098,596 | B2 | 8/2006 | Takagaki et al. | |
| 7,279,841 | B2 * | 10/2007 | Fukuyo et al. | 313/642 |
| 8,030,847 | B2 * | 10/2011 | Haacke et al. | 313/634 |
| 2002/0027421 | A1 * | 3/2002 | Kaneko et al. | 313/637 |
| 2003/0076041 | A1 * | 4/2003 | Honda et al. | 313/634 |

FOREIGN PATENT DOCUMENTS

| | | | |
|---|---|---|---|
| DE | 10354868 | A1 | 6/2004 |
| EP | 0978864 | A2 | 2/2000 |
| EP | 1349197 | A2 | 10/2003 |
| EP | 1465237 | A2 | 10/2004 |
| WO | 2004102614 | A1 | 11/2004 |
| WO | 2008007284 | A2 | 1/2008 |
| WO | 2008110967 | A1 | 9/2008 |

* cited by examiner

*Primary Examiner* — Mariceli Santiago

(57) ABSTRACT

A high pressure gas discharge lamp includes a discharge vessel with electrodes that project into a discharge space of a volume of 12-20 $mm^3$. The discharge space has a filling of rare gas and a metal halide composition which is free of mercury. The metal halide composition includes at least halides of Sodium and Scandium with a mass ratio of halides of Sodium and Scandium of 0.9-1.5. The lamp further includes an outer enclosure provided around the discharge vessel. The outer enclosure is sealed and filled with a gas at a pressure below 1 bar. The lamp has an efficiency equal to or greater than 90 Im/W in a steady state operation at an electrical power of 25 W.

15 Claims, 5 Drawing Sheets

HIGH EFFICIENCY DISCHARGE LAMP

FIELD OF THE INVENTION

The present invention relates to a high-pressure gas discharge lamp, in particular for use in automotive front lighting.

BACKGROUND OF THE INVENTION

Discharge lamps, specifically HID (high-intensity discharge) lamps are used for a large area of applications where high light intensity is required. Especially in the automotive field, HID lamps are used as vehicle headlamps.

A discharge lamp comprises a sealed discharge vessel, which may be made e.g. from quartz glass, with an inner discharge space. Two electrodes project into the discharge space, arranged at a distance from each other, to ignite an arc there between. The discharge space has a filling comprising a rare gas and further ingredients such as metal halides.

An important aspect today is energy efficiency. The efficiency of a discharge lamp may be measured as lumen output in relation to the electrical power used. In discharge lamps used today for automotive front lighting an efficiency of about 90 lumen per Watt (lm/W) is achieved at a steady state operating power of 35 Watt.

EP-A-1349197 describes a mercury free metal halide lamp for use in an automotive headlight. In order to achieve an enhanced luminous efficiency, a low lamp voltage reduction, light with a chromaticity suitable for an automotive headlamp, and an increased, rapidly rising luminous flux, the amount of first halides containing a scandium halide (mass a) and a sodium halide (mass b) are chosen such that $0.25<a/(a+b)<0.8$ and preferably $0.27<a/(a+b)<0.37$. A second halide (mass c) is present for providing a lamp voltage in place of mercury in an amount such that $0.01<c/(a+b+c)<0.4$, and preferably $0.22<c/(a+b+c)<0.33$. The halides are present in the discharge vessel in an amount of 0.005-0.03, preferably 0.005-0.02 mg/mm$^3$ of the inner volume. Additionally, Xenon gas is present in the discharge medium at 5-20 atmospheres cold pressure. Rod-shaped electrodes are provided with a shaft diameter of 0.3 mm or more which may be made of tungsten, doped tungsten, rhenium, a rhenium/tungsten alloy or the like. An outer envelope houses the discharge vessel, which may be hermetically sealed from the outside air or may have air or an inert gas at an atmospheric or reduced pressure sealed therein. In an example, tungsten electrodes of 0.35 mm diameter are provided in a discharge vessel of 34 mm$^3$. The discharge medium contains 0.1 mg of $ScI_3$, 0.2 mg of NaI and 0.1 mg of $ZnI_2$ with Xe gas at 10 atm at 25° C. In a first comparative example with a higher amount of the second halide the amount of halides are 0.08 mg $ScI_3$, 0.42 mg NaI and 0.30 mg $ZnI_2$. In a second comparative example the amount of halides are 0.1 mg $ScI_3$, 0.5 mg NaI and 0.2 mg $ZnI_2$.

SUMMARY OF THE INVENTION

It is an object of the present invention to provide a lamp that allows energy efficient operation.

Especially for the automotive field it would be desirable to have a discharge lamp with lower nominal power, e.g. in the range of 20-30 W. If such a lamp could be designed with high efficiency, such that sufficient total lumen output is achieved despite the lower electrical operating power, energy could be saved.

However, the inventors have recognized that simply operating existing lamp designs at lower nominal power will lead to drastically reduced efficiency. For example, a lamp which at 35 W operation has an efficiency of about 90 lm/W has at 25 W only an efficiency of around 62 inn/W. According to the invention, there is thus provided a lamp design aimed at high efficiency for operation at reduced nominal power, namely 25 W.

According to the invention, the discharge vessel has a volume of 12-20 mm$^3$ (or μl). Within the discharge space, there is provided a filling being at least substantially free of mercury, i.e. with no mercury at all or only unavoidable impurities thereof. The filling comprises a rare gas, preferably Xenon, and a metal halide composition.

The metal halide composition is carefully chosen to achieve a high lumen output. The composition comprises at least halides of Sodium (Na) and Scandium (Sc), preferably NaI and $ScI_3$. The mass ratio of the halides of Na and Sc is (mass of Na halide)/(mass of Sc halide)=0.9-1.5, preferably 1.0-1.3.

As a further measure to provide high efficiency, the lamp comprises an outer enclosure provided around the discharge vessel. The outer enclosure is preferably also made of quartz glass. The enclosure is sealed to the outside and filled with a gas at reduced pressure (pressure below 1 bar). The outer enclosure serves as insulation to keep the discharge vessel at a relatively high operation temperature, despite the reduced electrical power.

In total, the proposed lamp has an efficiency which is equal to or greater than 90 lm/W in a steady state operation at an electrical power of 25 W. In the present context, the efficiency measured in lm/W referred to is always measured at a burnt-in lamp, i.e. after the discharge lamp has been first started and operated for 45 minutes according to a burn-in sequence. Preferably, the efficiency at 25 W is even 92 lm/W or more, most preferably 95 lm/W or more.

As will become apparent in connection with the preferred embodiments discussed below, there are several measures which may be used to obtain a lamp of high efficiency, such that the above efficiency values are achieved even at a low operating power of 25 W. These measures refer on one hand to the discharge vessel itself, where a small inner diameter and a thin wall help to achieve high efficiency. On the other hand, this refers to the filling within the discharge space, where a relatively high amount of halides, and especially a high amount of the light emitting halides of Sodium and Scandium (as opposed to other halides, such as halides of Zinc (Zn) and Indium (In)) are provided. Further, the high pressure of the rare gas within the discharge space, and measures directed to lower the heat conduction via the outer enclosure serve to provide more lumen output.

The discharge vessel may have any desired shape. Preferably, it has an outside ellipsoid shape and an inner ellipsoid or cylindrical shape. In the following, several geometric parameters (wall thickness, inner/outer diameter etc.) of the discharge vessel will be discussed, where each of the parameters are to be measured in a plane central between the electrodes in orthogonal orientation thereto.

Regarding the discharge vessel, the geometric design of the lamp should be chosen according to thermal considerations. The "coldest spot" temperature should be kept high to achieve high efficiency. Generally, the inner diameter of the discharge vessel should be chosen relatively small, e.g. 2.0-2.5 mm. A minimum inner diameter of 2.0 mm is preferred to avoid too close proximity of the arc to the discharge vessel wall. According to a preferred embodiment, the discharge vessel has a maximum inner diameter of 2.0-2.3 mm.

The wall thickness of the discharge vessel may preferably be chosen to be 1.5-1.9 mm. According to a preferred embodiment, the wall thickness is 1.5-1.75 mm, so that a relatively small discharge vessel is provided, which has a reduced heat radiation and is therefore kept hot even at lower electrical powers.

Regarding the filling of the discharge space, the metal halide composition may be provided preferably in a concentration of 5-20 μg/μl of the volume of the discharge space. However, to achieve a high lumen output it is preferred to use at least 10 μg/μl. According to a further preferred embodiment, the metal halide concentration is 10.5-17.5 μg/μl to achieve a high lumen output.

Generally, the metal halide composition may comprise further halides besides halides of Sodium and Scandium. It is generally possible to further use halides of Zinc and Indium. However, these halides do not substantially contribute to the lumen output, so that according to a preferred embodiment the metal halide composition comprises at least 90 wt % halides of Scandium and Sodium. Further preferred, the metal halide composition comprises even more than 95% halides of Sodium and Scandium. In an especially preferred embodiment, the metal halide composition consists entirely of NaI and $ScI_3$ and does not comprise further halides. In an alternative embodiment, the metal halide composition consists of NaI, $ScI_3$ and a small addition of a thorium halide, preferably $ThI_4$. Thorium halide serves to lower the work function of the electrodes.

The rare gas provided in the discharge space is preferably Xenon. The rare gas may be provided at a cold (20° C.) filling pressure of 10-18 bar. Most preferably and especially preferred in connection with a halide composition that does not substantially comprise halides of Zinc and Indium, it is preferred to use a relatively high gas pressure of 15-18 bar. Such a high pressure provides high lumen output and at the same time may lead to a relatively high burning voltage, which may be in the range of 40-55 V, although the metal halide composition consists of only NaI and $ScI_3$ as well as (optionally) $ThI_4$.

The outer enclosure arranged around the discharge vessel is provided—besides other uses, such as e.g. blocking UV radiation—to achieve a certain, limited heat flow from the discharge vessel to the outside. The enclosure may preferably be made out of quartz glass and may be of any geometry, e.g. cylindrical, generally elliptical or other. It is preferred for the outer enclosure to have an outer diameter of at most 10 mm.

In order to reduce the heat flow from the discharge vessel, the outer enclosure is provided at a certain distance there from. For the purposes of measurement, the distance discussed here is measured in cross-section of the lamp taken at a central position between the electrodes. The gas filling of the outer enclosure is chosen, together with the distance and the pressure, such that a desired heat transition coefficient $$\frac{\lambda}{d_2}$$

is achieved. Preferred values for $$\frac{\lambda}{d_2}$$

are 7.0-225 $W/(m^2K)$, further preferred are 15.5-75 $W/(m^2K)$. Preferably, the outer enclosure is arranged at a distance of 0.2-0.9 mm to the discharge vessel.

According to a preferred embodiment, the gas filling of the outer enclosure is at a pressure of 10-700 mbar, further preferred 10-300 mbar. The gas filling is preferably a rare gas, most preferably chosen out of Xenon and Argon. Due to the lower thermal conductivity of Xenon, it is preferred to have at least 20%, further preferred at least 50% Xenon in the filling.

In a preferred embodiment, the electrodes are rod-shaped with a diameter of 215-275 μm. On one hand, the electrodes should be provided thick enough to sustain the necessary run-up current. On the other hand, electrodes for a lamp design with high efficiency at relatively low steady state power need to be thin enough to still be able to operate stably in steady state at low power. The inventors have found a model to explain power losses in the electrodes, so that the above dimensions are found to contribute to a high efficiency. Accordingly, the above range for an electrode diameter is proposed. Further preferred, the diameter is 230-260 μm.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

All embodiments shown are intended to be used as automotive lamps for vehicle head lights, conforming to ECE R99 and ECE R98. This, specifically, is not intended to exclude lamps for non-automotive use, or lamps according to other regulations. Since such automotive high pressure gas discharge lamps are known per se, the following description of the preferred embodiments will primarily focus on the special features of the invention.

Figure 1:
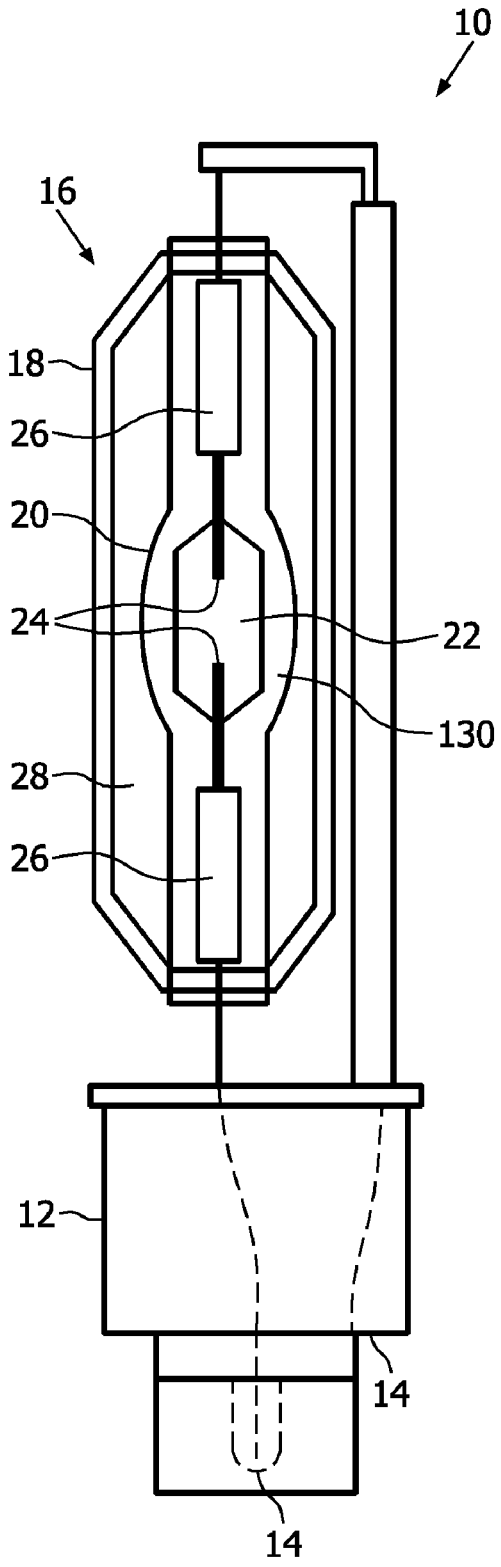
FIG. 1 shows a side view of a lamp according to a first embodiment of the invention.

FIG. 1 shows a side view of a first embodiment 10 of a discharge lamp. The lamp comprises a socket 12 with two electrical contacts 14 which are internally connected to a burner 16.

The burner 16 is comprised of an outer enclosure (in the following referred to as outer bulb) 18 of quartz glass surrounding a discharge vessel 20. The discharge vessel 20 is also made of quartz glass and defines an inner discharge space 22 with projecting, rod-shaped electrodes 24. The glass material from the discharge vessel further extends in longitudinal direction of the lamp 10 to seal the electrical connections to the electrodes 24 which comprise a flat molybdenum foil 26.

The outer bulb 18 is, in its central portion, of cylindrical shape and arranged around the discharge vessel 20 at a distance, thus defining an outer bulb space 28. The outer bulb space 28 is sealed.

Figure 2:
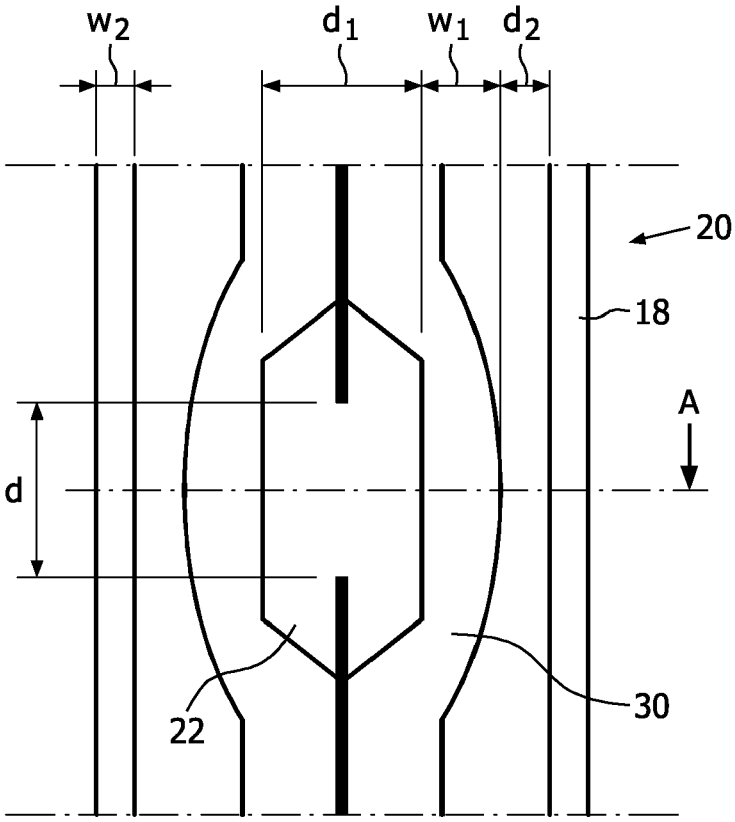
FIG. 2 shows an enlarged view of the central portion of the lamp shown in FIG. 1.

As shown in greater detail in FIG. 2, the discharge vessel 20 has an outer wall 30 arranged around the discharge space 22 (The outer shape of the wall 30 is ellipsoid.). The discharge space 22 is of cylindrical shape. It should be noted that the term "cylindrical" used here refers to the central, largest part of the discharge space 22 and does not exclude—as shown—differently shaped, e.g. conical end portions.

The wall 130 surrounding the discharge space 22 is consequently of varying thickness, with the thickness being greatest at a position corresponding to the center between the electrodes 24, and decreasing towards both sides.

Figure 2A:
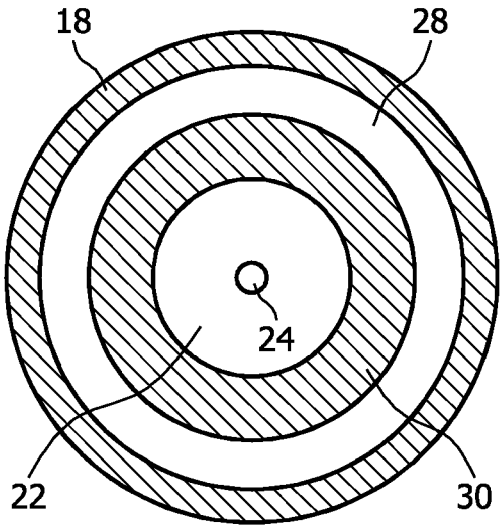
FIG. 2*a* shows a cross-sectional view along the line A in FIG. 2.

The discharge vessel 20 is characterized by the electrode distance d, the inner diameter $d_1$ of the discharge vessel 20, the wall thickness $w_1$ of the discharge vessel, the distance $d_2$ between the discharge vessel 20 and the outer bulb 18 and the wall thickness $w_2$ of the outer bulb 18. Here, the values $d_1$, $w_1$, $d_2$, $w_2$ are measured in a central perpendicular plane of the discharge vessel 20, as shown in FIG. 2*a*.

The lamp 10 is operated, as conventional for a discharge lamp, by igniting an arc discharge between the electrodes 24. Light generation is influenced by the filling comprised within the discharge space 22, which is free of mercury and includes metal halides as well as a rare gas.

Regarding the thermal behavior of a discharge lamp 10 as shown, it should be kept in mind that automotive lamps are intended to be operated horizontally. The arc discharge between the electrodes 24 will then lead to a hot spot at the wall 30 of the discharge vessel 20 above the arc. Likewise, opposed portions of the wall 30 surrounding the discharge space 22 will remain at comparatively low temperatures (coldest spot).

In order to reduce heat transport from the discharge vessel 20 to the outside, and to maintain high temperatures necessary for good efficacy, it is thus preferable to provide the outer bulb 18 with reduced heat conduction. In order to limit cooling from the outside, the outer bulb 18 is sealed and filled with a filling gas of reduced heat conductivity. The outer bulb filling is provided at reduced pressure (measured in the cold state of the lamp at 20° C.) of less than 1 bar. As will be further explained below, the choice of a suitable filling gas should be made in connection with the geometric arrangement in order to achieve the desired heat conduction from discharge vessel 20 to outer bulb 18 via a suitable heat transition coefficient $\lambda/d_2$.

The heat conduction to the outside may be roughly characterized by a heat transition coefficient $\lambda/d_2$, which is calculated as the thermal conductivity $\lambda$ of the outer bulb (which in the present context is always measured at a temperature of 800° C.) filling divided by the distance $d_2$ between the discharge vessel 20 and the outer bulb 18.

Due to the relatively small distance between the discharge vessel 20 and outer bulb 18, heat conduction between the two is essentially diffusive and will therefore be calculated as $\dot{q}=-\lambda \text{ grad } \upsilon$, where $\dot{q}$ is the heat flux density, i.e. the amount of heat transported per time between discharge vessel and outer bulb. A is the thermal conductivity and grad$\upsilon$ is the temperature gradient, which here may roughly be calculated as the temperature difference between discharge vessel and outer bulb, divided by the distance:

$$grad\vartheta = \frac{T_{dischargeVessel} - T_{outerBulb}}{d_2}.$$

Thus, cooling is proportional to $$\frac{\lambda}{d_2}.$$

In connection with the embodiments proposed in the present context, different types of filling gas, different values of filling pressure and different distance values $d_2$ may be chosen to obtain a desired transition coefficient $$\frac{\lambda}{d_2}.$$

The filling pressure is reduced (below 1 bar, preferably below 700 mbar, further preferred below 300 mbar). An especially preferred value is a filling pressure of 100 mbar. However, in the preferred region the heat transition coefficient changes very little with the pressure.

Preferred distances $d_2$ range from 0.2-0.9 mm. The filling may be any suitable gas, chosen by its thermal conductivity value $\lambda$ (measured at 800° C.). The following table gives examples of values for $\lambda$ (at 800° C.):

| | |
|---|---|
| Neon | 0.120 W/(mK) |
| Oxygen | 0.076 W/(mK) |
| Air | 0.068 W/(mK) |
| Nitrogen | 0.066 W/(mK) |
| Argon | 0.045 W/(mK) |
| Xenon | 0.014 W/(mK) |

To obtain good insulation, especially Argon, Xenon, or a mixture thereof is preferred as filling gas. However, since the heat transition coefficient is of course dependent on distance $d_2$, different gas fillings may also be chosen with a high enough $d_2$.

Preferred values for $$\frac{\lambda}{d_2}$$

range from 7.0 W/($m^2$K) (achieved e.g. by a Xenon filling at a large distance of $d_2$=1.95 mm) to 225 W/($m^2$K) (achieved e.g. by an Argon filling at a small distance of $d_2$=0.2 mm). Preferred is a range of 15.5 W/($m^2$K) (achieved e.g. by a Xenon filling at $d_2$=0.9 mm) to 75 W/($m^2$K) (achieved e.g. by an Argon filling at $d_2$=0.6 mm).

Model for Lamp Efficiency

The inventors have developed the following model for determining the luminus flux generated by the lamp 10:

$$F=\eta * P_{Arc},$$

where F is the luminus flux, measured in lumen, $\eta$ is the arc efficiency measured in lumen per watt (lm/W) and $P_{Arc}$ is the power of the electrical arc.

The total electrical power $P_{Lamp}$ is divided up into power which is lost at the electrodes and the arc power $P_{Arc}$:

$$P_{Lamp}=P_{El}+P_{Arc}.$$

The inventors have found that the power lost in the electrodes depends on the mode of arc attachment in the cathode phase, which may be either a spot mode, where the electrical arc is contracted so that the arc attachment is restricted to a small area at the electrode tip, or a diffuse mode, where the arc attachment covers (nearly) the whole front surface of the electrode tip.

The inventors have found that in spot mode, the electrode losses $P_{El}$ are not substantially dependent on electrode geometry, i.e. electrode diameter. They may be expressed as $$P_{El}=2*U_h*I,$$

where I is the lamp current and $U_h$ is a fixed heating voltage which for the present lamps may be assumed to be about 5 V.

For operation in diffuse mode, the electrode needs to sustain a certain high temperature. The power needed for this is dependent on the geometry of the electrodes. For a rod-shaped electrode of an electrode diameter of 300 μm, a heating power of 6 W is needed. For other diameters, the required heating power is approximately proportional to the square of the diameter. For a 200 μm electrode, a heating power of only 3 W is required.

In operation, the lamp will burn in the arc attachment mode which is energetically favorable, i.e. which uses the lower power. Thus, it is possible to choose the electrode diameter appropriately to obtain relatively low electrode losses.

Gas Phase Emitter

Besides Scandium halide, it is possible to use Thorium halide as a gas phase emitter. While Thorium-free designs are preferable for environmental reasons, it has been found that the addition of $ThI_4$ may improve the lamp efficiency by reducing electrode losses for lamps burning in spot mode.

The inventors have found that the efficiency of a lamp burning in spot mode may be dependent on the gas phase emitter. In $ThI_4$-free lamps, operation in spot mode, as opposed to operation in diffuse mode, reduced the electrode temperature by about 150 K, which corresponds to a reduction in heat load of less than 1 W. However in Th-containing lamps, the effect is about 300 K, which corresponds to 1-2 W in heat load. Therefore, while the efficiency benefit of the spot mode as opposed to diffuse mode is lower than anticipated in Th-free lamps, Th-containing lamps can significantly benefit. Thus, the addition of a small amount of e.g. $ThI_4$ may raise the efficiency of a 25 W lamp by about 3%.

Arc Efficiency η

To be able to propose lamp designs with overall high lumen efficiency, the inventors have studied factors contributing to arc efficiency. The following parameters contribute to the arc efficiency η, and may be adjusted accordingly to obtain a higher efficiency:

Discharge Space Filling:

amount of metal halides: By raising the total amount of strongly light emitting halides specifically of Sodium and Scandium, the arc efficiency η is raised.

metal halide composition:

By raising the amount of strongly light emitting halides, such as halides of Natrium and Scandium, in contrast to secondary halides, such as halides of Zinc and Indium, the arc efficiency is raised. Optimally, the metal halide composition only consists of halides of Sodium and Scandium In a metal halide composition with halides of Sodium and Scandium, the arc efficiency η is raised by choosing the mass ratio of Sodium halides and Scandium halides close to an about optimal value of 1.0.

Rare gas pressure: By raising the pressure of the rare gas, preferably Xenon, the arc efficiency is raised.

Thermal Measures: Raising "Coldest Spot" Temperature

If the discharge vessel is made smaller, the "coldest spot" temperature is raised, contributing to a high efficiency η.

Consequently, a smaller inner diameter of the discharge vessel leads to a higher efficiency η.

A reduced outer diameter, which may be achieved by a reduced wall thickness, reduces heat radiation, thus raises the "coldest spot" temperature and the efficiency η.

Insulation of the discharge vessel by providing an outer enclosure (outer bulb) to obtain a desired, low heat transition coefficient $$\frac{\lambda}{d_2}:$$

By providing the outer bulb at a greater distance $d_2$ from the discharge vessel, heat transfer is limited and the efficiency consequently raised.

By providing a gas filling in the outer enclosure with low heat conductivity λ, such as Argon, and even further preferred Xenon, the transfer may be further reduced.

Accordingly, by changing the above given parameters it is possible to suitably adjust the arc efficiency η to a desired value.

However, research conducted by the inventors has revealed a surprising fact: While the individual measures, and also combinations thereof, were effective to raise the efficiency up to a certain point, this only serves to raise the efficiency up to a maximum value, where even substantial variations of the above parameters do not substantially yield a further improved efficiency. Surprisingly, this maximum value, as determined in measurements by the inventors, is about constant and not substantially dependent on the individual parameters, i.e. the maximum value $\eta_{max}$ will be the same, regardless of the combination of parameters by which the efficiency is raised.

The following table shows in experiments, how the efficiency η is raised to a maximum value, but may then not be further increased despite significant further variation of the parameters. The experiment started from a reference lamp with a discharge vessel of an inner diameter of 2.4 mm and an outer diameter of 6.1 mm (volume of the discharge space 21 μl) with an outer enclosure of inner diameter 6.7 and outer diameter of 8.7 mm. The metal halides consisted of around 103.2 μg NaI, 77.2 $ScI_3$, 19.2 μg $ZnI_2$ and 0.4 μg InI together with Xenon at a cold pressure of 14 bar. The outer enclosure was filled with air at 100 mbar and the distance between the discharge vessel and the outer bulb was 0.3 mm. For each lamp, 10 pieces were manufactured and the resulting efficiency η measured. The arc efficiency η was measured at 35 W after 45 minutes burn-in:

| Batch | Lamp | η |
|---|---|---|
| 1 | Reference | 91 |
| 2 | Same as reference, but<br>1. without Zn $I_2$/InI<br>2. 300 μg halides<br>3. NaI/$ScI_3$ mass ratio 1.0<br>4. Xe pressure 16 bar (+15%)<br>5. outer bulb filling 100 mbar Xe | 104 |
| 3 | same as batch 2, but 400 μg halides | 103 |
| 4 | same as batch 2, but outer bulb distance 0.5 mm | 104 |
| 5 | same as batch 2, but smaller discharge vessel of 19 μl volume and Xe pressure 17 bar (+21%) | 105 |

-continued

| Batch | Lamp | η |
|---|---|---|
| 6 | same as batch 5, but<br>6. 400 μg halides<br>7. outer bulb distance 0.8 mm<br>8. 17 bar Xe pressure (+21%) | 104 |

There is thus clearly visible a maximum value of about 104 lm/W (in operation at 35 W) which regardless of parameter variation could not be surpassed. The inventors currently propose that the reason for this maximum value is, that by raising the coldest spot temperature the partial pressures of the species in the gas phase are raised, but this raising of the partial pressures also leads to an increased self-absorption of radiation.

This surprising effect may be used to advantage when designing a lamp. It should be kept in mind that the above given parameters, if adjusted only to achieve a high efficiency, will have negative side effects with regard to other requirements of a lamp. A rare gas filling pressure which is too high will negatively influence the lifetime of the lamp, which is why the current invention proposes to limit the Xenon pressure within the discharge space 22 to at most 18 bar. Also, the inner diameter d1, and the wall thickness w1 should not be chosen too small to avoid excessive (mechanical and thermal) wall loads. The same is true for the heat conductivity of the outer bulb 18, as given by the filling pressure, filling gas and distance $d_2$ of the outer bulb 18, which should not be chosen too small to avoid excessively high thermal load.

The above described surprising effect now allows a lamp designer to choose the above parameters to achieve the desired high lumen output, but also to limit further optimization in order not to incur unnecessary negative effects. In essence, an optimal lamp design may be chosen to achieve an arc efficiency η just at, or little less than, the experimentally found maximum value. In this region, a very high efficiency, close to the maximum possible, is achieved, without choosing excessive parameter values leading to negative effects such as limited lifetime.

Figure 5:
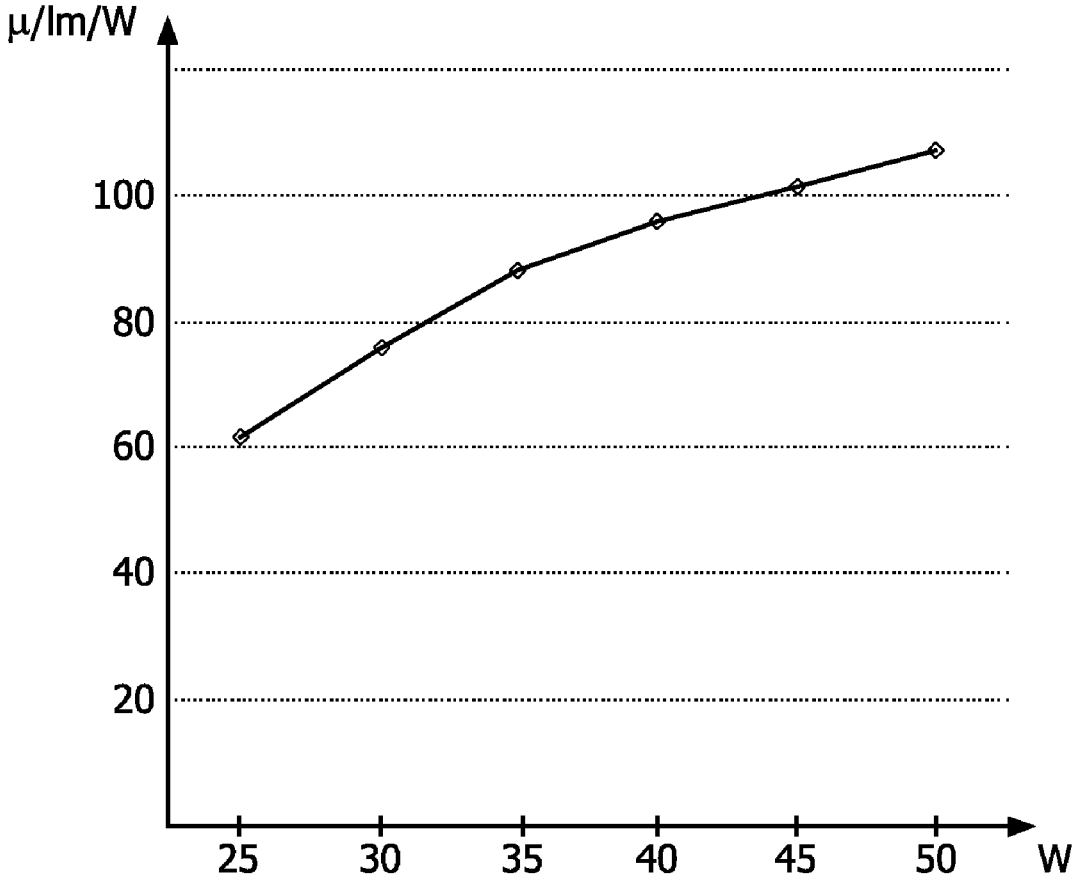
FIG. 5 shows a graph of measured lamp efficiency values over operating power.

It should be kept in mind that lamp efficiency for a certain design is strongly dependent on the operating power. As an example, FIG. 5 shows a graph with different measured values of lamp efficiency for the above given reference design (batch 1). While the efficiency η at 35 W is about 90 lm/W, this value increases up to 107 lm/W achieved at 50 W. However, at lower operating powers, the value decreases. At about 25 W, only an efficiency of 61 lm/W is achieved. Thus, for lamp designs intended to be used at lower operating powers, where lamp efficiency becomes especially important, it is not easy to obtain the desired high efficiency level.

In the following, in accordance with the observations related above, an embodiment of a lamp will be discussed, which is intended to be used at a (steady-state) level of operating power which is lower than prior designs. The nominal operating power of the embodiment is 25 W. The specific design is chosen with regard to thermal characteristics of the lamp in order to achieve high lamp efficacy.

In the preferred example, the discharge vessel and outer bulb are provided as follows:

Example Lamp 1 (25 W)
Discharge vessel: cylindrical inner shape
ellipsoid outer shape
Electrodes: rod-shaped
Electrode diameter: 300 μm
Electrode distance d: 4.2 mm optical
Inner diameter $d_1$: 2.2 mm
Outer diameter $d_1+2*w_1$: 5.5 mm
Discharge vessel volume: 19 μl
Wall thickness $w_1$: 1.65 mm
Outer bulb inner diameter: 6.7 mm
Outer bulb distance $d_2$: 0.6 mm
Outer bulb filling: Xenon 100 mbar
Heat transition coefficient:

$$\frac{\lambda}{d_2}\ 23.3\ \mathrm{W/(m^2K)},$$

measured at 800° C.
Outer bulb wall thickness $w_2$: 1 mm
The filling of the discharge space 22 consists of Xenon and a metal halide composition as follows:
Xenon pressure (at 25° C.): 17 bar
Halide composition: 150 μg NaI, 150 μg $ScI_3$
Total amount of halides: 300 μg
Amount of halides per $mm^3$
of the discharge space: 15.8 μg/μl
Mass ratio of NaI/$ScI_3$: 1.0
A batch of 10 lamps of the above example 1 was tested and the following measurements were made:
Efficiency: 97 lm/W
Voltage: 45.8 V
Colour: X 389
Colour: Y 398
Colour temperature Tc: 3933
It may thus be observed that in the above, preferred first example even at an operating power of 25 W a total lumen output of more than 2.400 lm is achieved.
In the following, variations of the above example are given.
Example 2 (25 W)
The discharge vessel and outer bulb dimensions are the same as in example 1. The following parameters were chosen differently from example 1:
Electrode diameter: 230 μm
Outer bulb filling: 50% Xenon, 50% Argon, 100 mbar
Heat transition coefficient:

$$\frac{\lambda}{d_2}\ 50\ \mathrm{W/(m^2K)},$$

measured at 800° C.
Xenon pressure (at 25° C.): 15.5 bar
Halide composition: 113 μg NaI, 83 μg $ScI_3$, 4 μg $ThI_4$
Total amount of halides: 200 μg
Amount of halides per $mm^3$
of the discharge space: 10.52 μg/μl
Mass ratio of NaI/$ScI_3$: 1.35
Due to the higher heat conductivity of the outer bulb, the increased mass ratio of NaI/$ScI_3$, the lower amount of halides and the lower Xenon pressure, the efficiency is only 91 lm/W, thus significantly lower than in example 1.
The metal halide composition includes a small amount of $ThI_4$ (which increases the efficiency) to lower the work function of the electrodes, which during run-up helps to limit the heat (electrode losses) generated in the electrodes by the high run-up current.
Example 3 (25 W)
To achieve a higher efficiency than in example 2, the total amount of halides in the following third example is raised with regard to example 2, such that the filling of the discharge space 22 is as follows:

Xenon pressure (at 25° C.): 15 bar

Halide composition: 170 μg NaI, 125 μg $ScI_3$, 6 μg $ThI_4$

Total amount of halides: 300 μg

Amount of halides per $mm^3$ of the discharge space: 15.8 μg/μl

Mass ratio of $NaI/ScI_3$: 1.35

Due to the higher amount of halides, the measured efficiency at 25 W is 93 lm/W, thus higher than in example 2.

Example 4 (25 W)

In a fourth example, all lamp parameters are the same as in the above third example with the exception of the outer bulb filling, which is provided as follows:

Outer bulb filling: Xenon 100 mbar

Heat transition coefficient:

$$\frac{\lambda}{d_2}\ 23.3\ W/(m^2K),$$

measured at 800° C.

The measured efficiency of 95 lm/W shows the positive influence of the lowered heat conductivity in the outer bulb.

Example 5 (25 W)

In a fifth example, all lamp parameters are the same as in the above first example, with the exception of the electrode diameter, which is chosen considerably smaller at 200 μm. The resulting efficiency is very high (101 lm/W).

Figure 3:
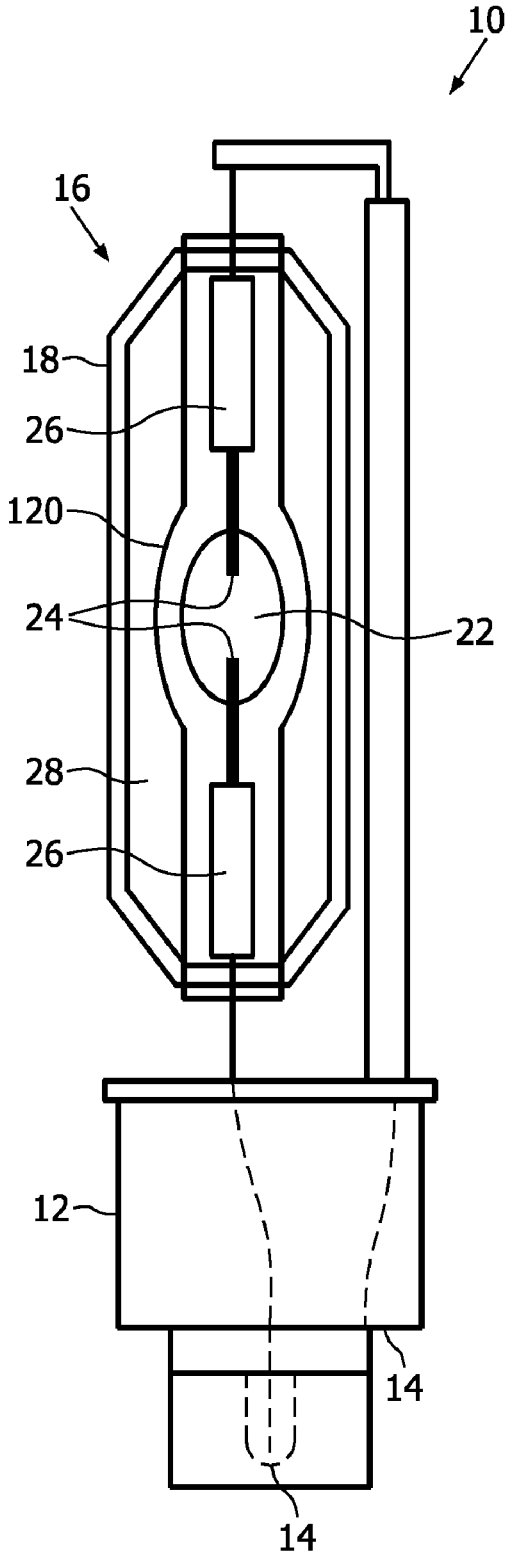
FIG. 3 shows a side view of a lamp according to a second embodiment of the invention.
Figure 4:
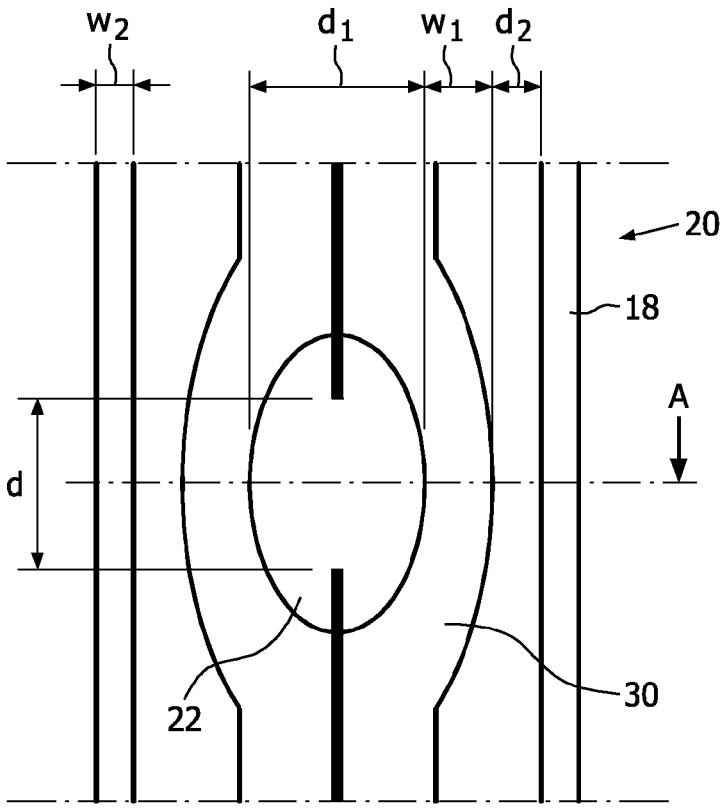
FIG. 4 shows an enlarged view of the central portion of the lamp shown in FIG. 3.
Figure 4A:
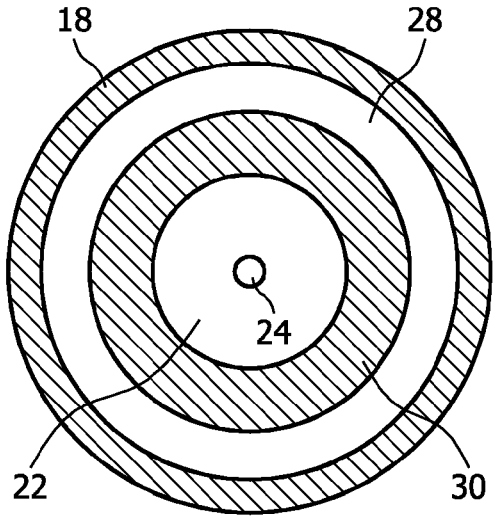
FIG. 4*a* shows a cross-sectional view along the line A in FIG. 4.

FIG. 3 shows a second embodiment of the invention. A lamp 110 according to the second embodiment comprises a discharge vessel 120 of different internal shape. The remaining parts of the lamp correspond to the lamp 10 according to the first embodiment. Like elements will be designated by like reference numerals, and will not be further described in detail.

The discharge vessel 120 of the lamp 110 has external ellipsoid shape, identical to the discharge vessel 20 according to the first embodiment. However, the internal discharge space 22 is cylindrical. Both the length and diameter of the inner discharge space 22 however are as in the above first embodiment.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the parameters are chosen differently within the intervals given in the appended claims. The above related observations regarding the effect of a variation of these parameters on lamp efficiency allow to choose the parameters to obtain the desired high efficiency above 90 lm/W, which in the present context is always to be measured at 25 W after a 45 min. burn-in procedure conducted with a horizontally oriented burner which is first started up and operated for 40 min, then turned off and rotated 180° around the on the longitudinal axis, turned on again and operated for a further 5 min before measurement of the lumen output.

Other variations to the disclosed embodiments can be understood and effected by those skilled in the art in practicing the claimed invention, from a study of the drawings, the disclosure, and the appended claims. In the claims, the word "comprising" does not exclude other elements, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A high pressure gas discharge lamp having an efficiency equal to or greater than 90 lm/W in a steady state operation at an electrical power of 25 W, the lamp comprising:

a discharge vessel defining a sealed inner discharge space and having at least two electrodes projecting into said discharge space, said discharge space having a volume of 12-20 $mm^3$ and comprising a filling of a rare gas and a metal halide composition, said filling being substantially free of mercury, said metal halide composition comprising at least halides of sodium and scandium, a mass ratio of halides of sodium and scandium being in the range of 0.9- 1.5, and an outer enclosure disposed around said discharge vessel, said outer enclosure being sealed and filled with a gas at a pressure below 1 bar.

2. A high pressure gas discharge lamp having an efficiency equal to or greater than 90 lm/W in a steady state operation at an electrical power of 25 W, the lamp comprising:

a discharge vessel defining a sealed inner discharge space and having at least two electrodes projecting into said discharge space, said discharge space having a volume of 12-20 $mm^3$ and comprising a filling of a rare gas and a metal halide composition, said filling being substantially free of mercury, said metal halide composition comprising at least halides of sodium and scandium, a mass ratio of halides of sodium and scandium being in the range of 0.9-1.5; and an outer enclosure disposed around said discharge vessel, said outer enclosure being sealed and filled with a gas at a pressure below 1 bar, wherein said discharge vessel has a maximum inner diameter in the range of 2.0 mm to 2.3 mm.

3. A high pressure gas discharge lamp having an efficiency equal to or greater than 90 lm/W in a steady state operation at an electrical power of 25 W, the lamp comprising:

a discharge vessel defining a sealed inner discharge space and having at least two electrodes projecting into said discharge space, said discharge space having a volume of 12-20 $mm^3$ and comprising a filling of a rare gas and a metal halide composition, said filling being substantially free of mercury, said metal halide composition comprising at least halides of sodium and scandium, a mass ratio of halides of sodium and scandium being in the range of 0.9- 1.5; and an outer enclosure disposed around said discharge vessel, said outer enclosure being sealed and filled with a gas at a pressure below 1 bar, wherein said discharge vessel has a wall thickness in the range of 1.5 mm to 1.75 mm.

4. The discharge lamp according to claim 1, wherein said discharge space comprises 10-23 μg of said metal halide composition per μl of said volume of said discharge space.

5. The discharge lamp according to claim 1, wherein said discharge space comprises 10.5-17.5 μg of said metal halide composition per μl of said volume of said discharge space.

6. The discharge lamp according to claim 1, wherein said metal halide composition comprises at least 90 wt % halides of sodium and scandium.

7. The discharge lamp according to claim 1, wherein said metal halide composition consists essentially of NaI and $ScI_3$.

8. The discharge lamp according to claim 1, wherein said rare gas in said discharge space is Xenon, provided at a cold pressure in the range of 10 bar to 18 bar.

9. A high pressure gas discharge lamp having an efficiency equal to or greater than 90 lmM/ in a steady state operation at an electrical power of 25W, the lamp comprising:

a discharge vessel defining a sealed inner discharge space and having at least two electrodes projecting into said discharge space, said discharge space having a volume of 12-20 $mm^3$ and comprising a filling of a rare gas and a metal halide composition, said filling being substantially free of mercury, said metal halide composition comprising at least halides of sodium and scandium, a mass ratio of halides of sodium and scandium being in the range of 0.9-1.5; and an outer enclosure disposed around said discharge vessel, said outer enclosure being sealed and filled with a gas at a pressure below 1 bar, wherein said outer enclosure is arranged at a distance ($d_2$) and filled with a filling gas such that a heat conduction coefficient $$\frac{\lambda}{d_2}$$

is 7.0- 225 W/($m^2$K, where λ is the thermal conductivity of the filling gas measured at 800° C. and $d_2$ is the distance between said outer enclosure and said discharge vessel.

10. The discharge I lamp according to claim 9, wherein the distance $d_2$ is in a range of 0.2 mm to 0.9 mm.

11. The discharge lamp according to claim 9, wherein said outer enclosure is filled with a further rare gas at a pressure in the range of 10 mbar to 700 mbar.

12. The discharge lamp according to claim 9, wherein said outer enclosure is filled with a gas comprising at least one of Xenon and Argon.

13. A high pressure gas discharge lamp having an efficiency equal to or greater than 90 lm/W in a steady state operation at an electrical power of 25 W, the lamp comprising:

a discharge vessel defining a sealed inner discharge space and having at least two electrodes proiecting into said discharge space, said discharge space having a volume of 12-20 $mm^3$ and comprising a filling of a rare gas and a metal halide composition, said filling being substantially free of mercury, said metal halide composition comprising at least halides of sodium and scandium, a mass ratio of halides of sodium and scandium being in the range of 0.9- 1.5; and an outer enclosure disposed around said discharge vessel, said outer enclosure being sealed and filled with a gas at a pressure below 1 bar, wherein said electrodes are rod-shaped electrodes having a diameter in a range of 215-275 μm.

14. The discharge lamp according to claim 1, wherein said metal halide composition consists essentially of NaI, $ScI_3$ and $ThI_4$.

15. The discharge lamp according to claim 1, wherein the volume of the discharge space volume is 12-19 $mm^3$.

* * * * *